US006051421A

United States Patent [19]

Sauer et al.

[11] Patent Number: 6,051,421

[45] Date of Patent: Apr. 18, 2000

[54] CONTINUOUS PROCESSING APPARATUS AND METHOD FOR CLEANING ARTICLES WITH LIQUIFIED COMPRESSED GASEOUS SOLVENTS

[75] Inventors: Richard A. Sauer, Hinsdale; Robert W. Conners, Western Springs; Per O. Sundin, Naperville, all of Ill.

[73] Assignee: Air Liquide America Corporation, Houston, Tex.

[21] Appl. No.: 08/709,655

[22] Filed: Sep. 9, 1996

[51] Int. Cl.[7] ..... F26B 21/14

[52] U.S. Cl. ..... 435/283.1; 34/72; 8/142; 510/285

[58] Field of Search ..... 68/5, 18; 34/72; 134/61, 71, 113, 200; 435/283.1; 510/285; 8/142

[56] References Cited

U.S. PATENT DOCUMENTS

| | | | |
|---|---|---|---|
| 4,726,287 | 2/1988 | Gerdes et al. | 454/554 |
| 5,267,455 | 12/1993 | Dewees et al. | 68/5 |
| 5,313,965 | 5/1994 | Palen | 134/61 |
| 5,412,958 | 5/1995 | Iliff et al. | 68/5 |
| 5,467,492 | 11/1995 | Chao et al. | 8/159 |
| 5,560,823 | 10/1996 | Whiting | 210/205 |
| 5,676,737 | 10/1997 | Whitlock | 95/90 |

FOREIGN PATENT DOCUMENTS

| | | |
|---|---|---|
| 0 679 753 A2 | 11/1995 | European Pat. Off. . |
| 39 04 514 A1 | of 1990 | France . |
| 39 04 514 A1 | 8/1990 | Germany . |
| 4004111 A1 | 8/1990 | Germany . |
| WO 92/14558 | 9/1992 | WIPO . |

OTHER PUBLICATIONS

Harvey Black, A Cleaner Bill of Health, Enviromental Health Perspectives, May/1996, (3 Pgs. Total).

*Primary Examiner*—Laurie Scheiner
*Assistant Examiner*—J. S. Parkin
*Attorney, Agent, or Firm*—Burns, Doane, Swecker & Mathis, L.L.P.

[57] ABSTRACT

The present invention relates to a continuous processing apparatus and method for cleaning articles with a liquified compressed gaseous solvent mixture. The continuous processing apparatus includes three processing chambers including an entrance chamber, a cleaning chamber, and an exit chamber. The chambers are provided with hatches which are opened and closed at appropriate times to allow the articles to be cleaned to pass into and out of the chambers. The entrance chamber is used for evacuation of the incoming articles to remove the majority of the air and moisture from the articles. After evacuation of the incoming articles, the entrance chamber is pressurized and the articles pass into the cleaning chamber. The cleaning chamber is maintained at a temperature and a pressure at which the liquified compressed gaseous solvent mixture is in a subcritical state and a liquid/gas interface exists between a liquid and a gas portion of the liquified compressed gaseous solvent mixture. The cleaned articles are then passed into a pressurized exit chamber where the liquified compressed gaseous solvent mixture remaining in the articles is evacuated before the cleaned articles are removed from the apparatus.

29 Claims, 1 Drawing Sheet

CONTINUOUS PROCESSING APPARATUS AND METHOD FOR CLEANING ARTICLES WITH LIQUIFIED COMPRESSED GASEOUS SOLVENTS

This application is related to U.S. patent application Ser. No. 08/709,656, filed on Sep. 9, 1996 (Attorney Docket No. 016499-136) entitled "Pressure-Swing Absorption Based Cleaning Methods and Systems" which is incorporated herein by reference.

BACKGROUND OF THE INVENTION

1. Field of the Invention

The present invention relates to a continuous cleaning system, and more particularly to a continuous cleaning system using a liquified compressed gaseous solvent mixture.

2. Description of the Related Art

Conventional solvent-aided cleaning processes for cleaning sensitive substrates such as fabrics or delicate electronic components have generally used dry cleaning solvents such as perchloroethylene. Due to concerns of air pollution, potential ozone depletion, occupational health and safety, and waste disposal, conventional dry cleaning solvents are being replaced with other less hazardous cleaning fluids. For these reasons, the eventual replacement of petroleum based solvents and chlorinated hydrocarbons as solvents would be desirable.

The use of a liquified compressed gaseous solvent or solvent mixture is being investigated as an alternative to conventional dry cleaning solvents. Some liquified gases are good solvents and remain in liquid phase at near ambient temperature if kept pressurized. These properties make liquified compressed gases desirable for use as solvents in cleaning processes. In particular, liquid carbon dioxide in a supercritical state has been used in garment cleaning processes to remove contaminants from garments.

One such dry cleaning system using supercritical carbon dioxide for dry cleaning of fabrics is disclosed in U.S. Pat. No. 5,267,455. In that system the cleaning is accomplished by agitation of the clothing within a pressurized vessel containing carbon dioxide in a supercritical state. The carbon dioxide is then drained, vaporized and then condensed to remove the contaminants which have been removed from the fabric. The carbon dioxide may then be reused in the cleaning system. However, it would be desirable to be able to continuously clean articles without the need for interruptions in the process to load and unload articles, and to depressurize and repressurize a cleaning chamber.

U.S. Pat. No. 5,313,965 discloses a continuous operation supercritical fluid treatment process in which items are processed in a continuously pressurized main process vessel by use of an entry airlock and an exit airlock. However, due to the high pressures necessary to achieve a supercritical state of the solvent in the system of U.S. Pat. No. 5,313,965, expensive high strength vessels are required.

SUMMARY OF THE INVENTION

The device according to the present invention addresses the disadvantages of the prior art by providing a continuous cleaning process which is capable of cleaning a continuous stream of articles and is environmentally friendly and safe.

As used herein, the term "liquified compressed gaseous solvent mixture or solvent mixture" means a composition comprising at least one liquified gaseous fluid in its subcritical state, which may optimally contain surfactants, brighteners, coupling agents, and the like.

A fluid in its subcritical state exists at a pressure and temperature less than the critical pressure and temperature for the substance and will, in general, be utilized as a saturated liquid (liquid in equilibrium with a small amount of vapor) or a sub-cooled liquid (liquid at a colder temperature with no bubbles).

As used herein, the term "continuous" means characterized by uninterrupted extension in time or sequence, without intermission, or recurring regularly after small interruptions.

According to one aspect of the invention, a cleaning system for cleaning articles with a liquified compressed gaseous solvent mixture includes an entrance chamber having an entrance hatch for receiving articles to be cleaned into the cleaning system, an exit chamber having an exit hatch for removing the articles which have been cleaned from the cleaning system, pressurization means for pressurizing the entrance chamber and the exit chamber with the liquified compressed gaseous solvent mixture in a gaseous form, depressurization means for depressurizing the entrance chamber and the exit chamber, at least one cleaning chamber connected to the entrance chamber by a first hatch and connected to the exit chamber by a second hatch, recirculation means for maintaining the liquified compressed gaseous solvent mixture within the at least one cleaning chamber at a temperature and pressure at which the liquified compressed gaseous solvent mixture is in a subcritical state, agitation means within the at least one cleaning chamber for agitating the articles to be cleaned within the at least one cleaning chamber, and wherein the cleaning system operates in a continuous sequence.

According to another aspect of the present invention, a cleaning method for cleaning articles with a liquified compressed gaseous solvent mixture includes: placing articles to be cleaned in an entrance chamber; pressurizing the entrance chamber with the liquified compressed gaseous solvent mixture in a gaseous form; moving the articles from the pressurized entrance chamber to a cleaning chamber containing the liquified compressed gaseous solvent mixture at a subcritical state; agitating the articles and the liquified compressed gaseous solvent mixture within the cleaning chamber to remove contaminants from the articles; pressurizing an exit chamber with liquified compressed gaseous solvent mixture in a gaseous form; moving the articles from the cleaning chamber to the pressurized exit chamber; depressurizing the exit chamber and removing the cleaned articles; and wherein the cleaning method operates in a continuous sequence.

BRIEF DESCRIPTION OF THE DRAWING FIGURES

The invention will be described in greater detail with reference to the accompanying drawing in which like elements bear like reference numerals, and wherein:

FIG. 1 is a schematic diagram of the continuous cleaning system according to the present invention.

DETAILED DESCRIPTION

Figure 1:
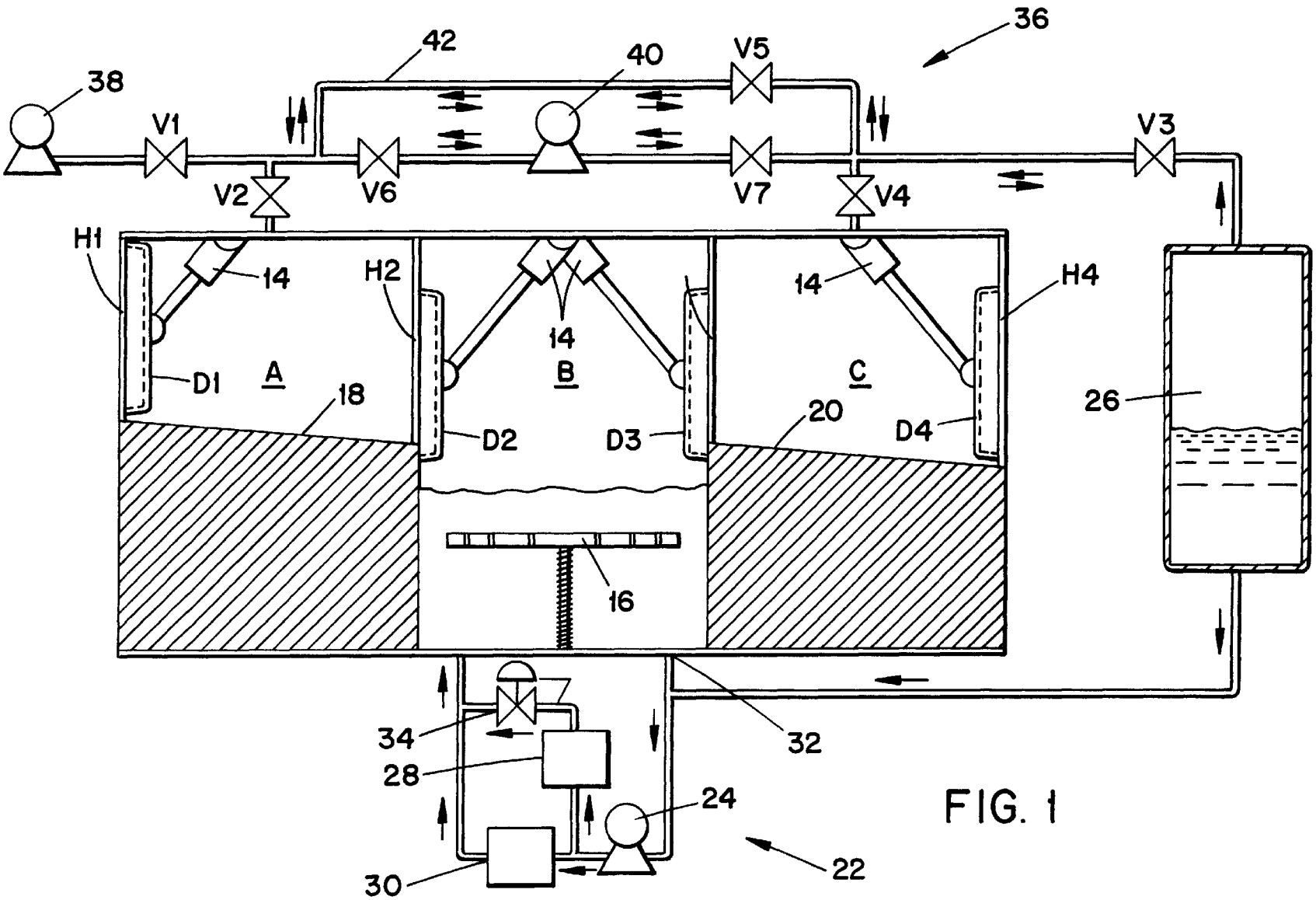

The continuous processing apparatus according to the present invention as illustrated in FIG. 1 has three processing chambers including an entrance chamber A, a cleaning chamber B, and an exit chamber C. The chambers are provided with hatches H1–H4 with hatch doors D1–D4 which open and close at appropriate times to allow the articles to be cleaned to pass into and out of the chambers. Each of the hatch doors D1–D4 have an associated hatch opening and closing mechanism 14. Hatch opening and closing mechanisms 14 may include hydraulic, pneumatic or other actuating mechanisms which move the hatch doors D1–D4 between a closed position in which the hatch is sealed and an open position.

The system according to the present invention may be operated with any liquified compressed gaseous solvent mixture with suitable solvent properties such as carbon dioxide, carbon dioxide based mixtures or other known solvents such as xenon, nitrous oxide, sulfur hexafluoride, ethane, ethylene, acetylene, fluorinated hydrocarbons, such as $CF_4$ and $C_2F_6$, or mixtures of any of the above. Preferably, the solvent mixture composition is a composition having a critical temperature near ambient and a low critical pressure. A preferred liquified compressed gaseous solvent mixture for use in the cleaning system of the present invention is a carbon dioxide based fluid comprising a mixture of carbon dioxide and several co-solvents and/or surfactants.

The surfactant used may be an anionic, nonionic, cationic or amphoteric surfactant. Illustrative anionic surfactants for use in the invention include dodecylbenzene sulfonic acid, sodium dodecylbenzene sulfonate, potassium dodecylbenzene sulfonate, triethanolamine dodecylbenzene sulfonate, morpholinium dodecylbenzene sulfonate, ammonium dodecylbenzene sulfonate, isopropylamine dodecylbenzene sulfonate, sodium tridecylbenzene sulfonate, sodium dinonylbenzene sulfonate, potassium didodecylbenzene sulfonate, dodecyl diphenyloxide disulfonic acid, sodium dodecyl diphenyloxide disulfonate, isopropylamine decyl diphenyloxide disulfonate, sodium hexadecyloxypoly (ethyleneoxy) (10)ethyl sulfonate, potassium octylphenoxypoly(ethyleneoxy) (9)ethyl sulfonate, sodium alpha olefin sulfonate, sodium hexadecane-1 sulfonate, sodium ethyl oleate sulfonate, potassium octadecenylsuccinate, sodium oleate, potassium laurate, triethanolamine myristate, morpholinium tallate, potassium tallate, sodium lauryl sulfate, diethanolamine lauryl sulfate, sodium laureth (3) sulfate, ammonium laureth (2) sulfate, sodium nonylphenoxypoly(ethyleneoxy) (4) sulfate, sodium diisobutylsulfosuccinate, disodium lauryl-sulfosuccinate, tetrasodium N-laurylsulfosuccinimate, sodium decyloxypoly(ethyleneoxy(5)methyl)carboxylate, sodium octylphenoxypoly(ethyleneoxy(8)methyl)-carboxylate, sodium mono decyloxypoly(ethyleneoxy) (4)phosphate, sodium di decyloxypoly(ethyleneoxy) (6)phosphate, and potassium mono/di octylphenoxypoly(ethyleneoxy) (9)phosphate. Other anionic surfactants known in the art may also be employed.

Among the useful nonionic surfactants which may be employed are octylphenoxypoly(ethyleneoxy) (11)ethanol, nonylphenoxypoly(ethyleneoxy) (13)ethanol, dodecylphenoxypoly(ethyleneoxy) (10)ethanol, polyoxyethylene (12) lauryl alcohol, polyoxyethylene (14) tridecyl alcohol, lauryloxypoly(ethyleneoxy) (10)ethyl methyl ether, undecylthiopoly(ethyleneoxy) (12)ethanol, methoxypoly (oxyethylene(10)/(oxypropylene(20))-2-propanol block co-polymer, nonyloxypoly(propyleneoxy) (4)/(ethyleneoxy) (16)ethanol, dodecyl polyglycoside, polyoxyethylene (9) monolaurate, polyoxyethylene (8) monoundecanoate, polyoxyethylene (20) sorbitan monostearate, polyoxyethylene (18) sorbitol monotallate, sucrose monolaurate, lauryldimethylamine oxide, myristyldimethylamine oxide, lauramidopropyl-N,N-dimethylamine oxide, 1:1 lauric diethanolamide, 1:1 coconut diethanolamide, 1:1 mixed fatty acid diethanolamide, polyoxyethylene(6)lauramide, 1:1 soya diethanolamidopoly(ethyleneoxy) (8) ethanol, and coconut diethanolamide. Other known nonionic surfactants may likewise be used.

Illustrative useful cationic surfactants include a mixture of n-alkyl dimethyl ethylbenzyl ammonium chlorides, hexadecyltrimethylammonium methosulfate, didecyldimethylammonium bromide and a mixture of n-alkyl dimethyl benzyl ammonium chlorides. Similarly useful amphoteric surfactants include cocamidopropyl betaine, sodium palmityloamphopropionate, N-coco beta-aminopropionic acid, disodium N-lauryliminodipropionate, sodium coco imidazoline amphoglycinate and coco betaine. Other cationic and amphoteric surfactants known to the art may also be utilized.

The co-solvents or coupling agents which may be utilized in the practice of the present invention include sodium benzene sulfonate, sodium toluene sulfonate, sodium xylene sulfonate, potassium ethylbenzene sulfonate, sodium cumene sulfonate, sodium octane-1-sulfonate, potassium dimethylnaphthalene sulfonate, ammonium xylene sulfonate, sodium n-hexyl diphenyoxide disulfonate, sodium 2-ethylhexyl sulfate, ammonium n-butoxyethyl sulfate, sodium 2-ethylhexanoate, sodium pelargonate, sodium n-butoxymethyl carboxylate, potassium mono/di phenoxyethyl phosphate, sodium mono/di n-butoxyethyl phosphate, triethanolamine trimethylolpropane phosphate, sodium capryloamphopropionate, disodium capryloiminodipropionate, and sodium capro imidazoline amphoglycinate. Certain water-soluble solvents known to the art such as propylene glycol ethers (e.g. tripropyleneglycol monomethyl ether) can be used in the practice of the invention. Additional co-solvents known to the art may also be utilized.

Although the temperatures and pressures employed in the present invention will be described in terms of the temperatures and pressures for a system using a pure carbon dioxide solvent, it should be understood that one of ordinary skill in the art would be able to determine the appropriate operating temperatures and pressures for other carbon dioxide based solvent compositions, based on the disclosure for pure carbon dioxide. The temperatures and pressures for other carbon dioxide based solvents will be similar to those for pure carbon dioxide. The temperatures and pressures for non-carbon dioxide based solvent mixtures will depend on the individual material properties of the pure solvents.

Articles are loaded into the cleaning system of the present invention by opening hatch H1 which allows the articles to pass into entrance chamber A. Entrance chamber A is used for evacuation of the incoming articles to remove the majority of the air and moisture from the articles. After evacuation of the incoming articles, entrance chamber A is pressurized with the vapor component of the liquified compressed gaseous solvent mixture to a pressure which is the same as or greater than the pressure of cleaning chamber B. Door D2 of hatch H2 is then opened to allow the garments within entrance chamber A to pass into cleaning chamber B.

Cleaning chamber B is maintained at a temperature and a pressure at which the liquified compressed gaseous solvent mixture is in a subcritical state. At the subcritical state, there is a liquid/gas interface between a liquid portion and a gas portion of the liquified compressed gaseous solvent mixture within cleaning chamber B. The preferred pressure for performing cleaning within cleaning chamber B ranges from about 500 psig to about 1000 psig (about 3448 kPa to about 6897 kPa), preferably from 550 psig to 590 psig (3793 kPa to 4069 kPa), and more preferably from 560 psig to 580 psig (3862 kPa to 4000 kPa).

The articles which pass into cleaning chamber B are immersed in the liquified compressed gaseous solvent mixture at the subcritical state and are preferably agitated within the chamber to increase the contact between the fluid and articles. The liquid/gas interface in the liquified compressed gaseous solvent mixture provides a more vigorous agitation of the articles due to the difference in density between the liquid and gas phases.

According to a preferred embodiment of the invention, a reciprocating perforated tray 16 is positioned within cleaning chamber B and is used to agitate the articles to provide increased contact between the articles and the liquified compressed gaseous solvent mixture within cleaning chamber B. Reciprocating perforated tray 16 is used to provide good mixing of the articles with the liquified compressed gaseous solvent mixture and to lift the articles to a height at which they can be easily pushed into exit chamber C through hatch H3. Although, perforated tray 16 is illustrated as an agitation mechanism, other agitation mechanisms such as fluid jets, mechanical conveyors, or rotary or linear mechanical agitators may also be used.

Door D3 of hatch H3 opens to allow the articles which have been cleaned in cleaning chamber B to pass into exit chamber C. Exit chamber C is used to hold the articles while the pressure is let down and a vacuum is pulled to dry off any residual solvent odors remaining in the articles. The door D4 to the last hatch H4 is then opened to remove the cleaned articles from exit chamber C. In accordance with the above described process there is a continuous stream of articles moving through the system because a new load of articles to be cleaned is already in the entrance chamber A as the exit chamber C is being depressurized to allow for removal of the cleaned articles.

As shown in FIG. 1, the floors 18, 20 of entrance chamber A and exit chamber C are sloped from a highest end at an entrance end of each of the chambers to a lowest end at an exit end of each of the chambers. The sloped chamber floors 18, 20 help to move the articles from one chamber to the next within the cleaning system and out of the exit chamber. In addition, a small pressure differential between the successive chambers A, B, C may be used to assist moving of the articles from one chamber to the next. For example, a pressure differential of 5 psig to 20 psig (35 kPa to 138 kPa), preferably 10 psig (69 kPa) would be beneficial in moving the articles along the sloped floors of the chambers when the doors D2, D3, D4 are opened. In one example of the present invention, entrance chamber A is maintained at a pressure of about 580 psig (4000 kPa) just prior to transport of the garments into cleaning chamber B which is at a pressure of about 570 psig (3931 kPa), and exit chamber C is maintained at a pressure of about 560 psig (3862 kPa) prior to transport of the garments into the exit chamber.

The continuous processing apparatus according to the present invention includes additional equipment for supplying and evacuating the process fluids to and from the system and for agitating the liquified compressed gaseous solvent mixture within the cleaning chamber B. A liquid delivery and regeneration system 22 is provided for delivering liquified compressed gaseous solvent mixture in a liquid state to the cleaning chamber B and for recirculating and regenerating the liquid solvent mixture within the cleaning chamber. System 22 includes a pump 24 which is preferably a high pressure centrifugal pump for pressurizing cleaning chamber B with liquified compressed gaseous solvent mixture from a storage vessel 26.

During cleaning, the liquified compressed gaseous solvent mixture is preferably continuously recirculated through a filtration system 28 and a regeneration system 30. The liquified compressed gaseous solvent mixture exits cleaning chamber B through an outlet 32 and is recirculated by pump 24 is back to the cleaning chamber. During recirculation, a portion of the liquified compressed gaseous solvent mixture passes through the filtration system 28, while the remainder of the liquified compressed gaseous solvent mixture from cleaning chamber B passes through the solvent regeneration system 30.

The filtration system 28 may include one or more filters for removing contaminants which have become entrained in the liquified compressed gaseous solvent mixture. The solvent regeneration system 30 operates to remove soluble and insoluble contaminants from the liquified compressed gaseous solvent mixture by evaporation and condensation of the solvent mixture. The percentage of the liquified compressed gaseous solvent mixture which passes to the filtration system 28 and to the regeneration system 30 may be altered by providing appropriate valves, such as a back pressure regulator valve 34.

In addition to these systems a temperature control system (not shown) may also be provided which heats and/or cools the liquified compressed gaseous solvent mixture to achieve a desired temperature and pressure within the cleaning chamber. The temperature control system may be provided either within recirculation system 22, within solvent storage tank 20, or directly within cleaning chamber B.

Also illustrated in the drawings is a system 36 for evacuating and pressurizing entrance chamber A and exit chamber C. System 36 includes a vacuum pump 38, a gas pump 40, a bypass pipe 42, and a series of valves V1–V7. The evacuation of entrance chamber A after placing the articles within the entrance chamber is performed by opening valves V1 and V2 and operating vacuum pump 38. After entrance chamber A has been evacuated, the entrance chamber is then pressurized with the gaseous component of the liquified compressed gaseous solvent mixture to the pressure of the storage vessel 26 by opening the valves V2, V3, and V5 and closing the valve V1. The entrance chamber A may be pressurized to pressures above that of storage vessel 26 by operation of the gas pump 40 and by opening the valves V2, V3, V6, and V7.

Exit chamber C is pressurized with the gaseous component of the liquified compressed gaseous solvent mixture prior to passing the articles from cleaning chamber B into the exit chamber. The pressurization of exit chamber C is performed by opening valves V3 and V4 and allowing the pressurized gas from storage vessel 26 to pass into the chamber. Once the articles have been placed in exit chamber C, the exit chamber is evacuated by the vacuum pump 38. Alternatively, the liquified compressed gaseous solvent mixture may be evacuated from exit chamber C by pump 40 for use in pressurizing entrance chamber A and vice versa.

Storage vessel 26 includes a temperature sensing and control system to maintain the temperature and equilibrium pressure of the contents of the storage vessel. The storage vessel 26 also preferably includes a pressure sensing and relief system, a level indicator, a solvent analyzer, and component supplies. The temperature and pressure control systems preferably operate by activating a heater in the liquid space within the storage vessel 26 to raise the pressure via vaporization or by activating a refrigeration system in the vapor space of the storage vessel to lower the pressure via condensation.

While the invention has been described in detail with reference to a preferred embodiment thereof, it will be apparent to one skilled in the art that various changes can be made, and equivalents employed without departing from the spirit and scope of the invention.

What is claimed is:

1. A cleaning system for cleaning articles with a liquified compressed gaseous solvent mixture including at least one liquified gaseous fluid in its subcritical state, the cleaning system comprising:

an entrance chamber having an entrance hatch for receiving articles to be cleaned into the cleaning system;

an exit chamber having an exit hatch for removing the articles which have been cleaned from the cleaning system;

pressurization means for pressurizing the entrance chamber and the exit chamber with the liquified compressed gaseous solvent mixture in a gaseous form;

depressurizing means for depressurizing the entrance chamber and the exit chamber;

at least one cleaning chamber connected to the entrance chamber by a first hatch and connected to the exit chamber by a second hatch;

recirculation means for maintaining the liquified compressed gaseous solvent mixture within the at least one cleaning chamber at a temperature and pressure at which the liquified compressed gaseous solvent mixture is in a subcritical state and has a liquid/gas interface;

agitation means within the at least one cleaning chamber for agitating the articles to be cleaned within the at least one cleaning chamber; and wherein the cleaning system operates in a continuous sequence.

2. The cleaning system according to claim 1, wherein the agitation means includes a reciprocating tray.

3. The cleaning system according to claim 1, wherein the entrance chamber has an angled floor which directs the articles from the entrance chamber into the at least one cleaning chamber when the first hatch is opened.

4. The cleaning system according to claim 1, wherein the exit chamber has an angled floor which directs the articles from the exit chamber out of the cleaning system through the exit hatch.

5. The cleaning system according to claim 1, wherein the pressurization means pressurizes the entrance chamber to a pressure which is higher than a pressure in the at least one cleaning chamber and pressurizes the exit chamber to a pressure which is lower than the pressure in the at least one cleaning chamber.

6. The cleaning system according to claim 1, wherein the recirculation system includes a filtration system for removing insoluble contaminants from a fluid portion of the liquified compressed gaseous solvent mixture within the cleaning chamber.

7. The cleaning system according to claim 1, wherein the recirculation system includes a solvent regeneration system which evaporates and condenses the liquified compressed gaseous solvent mixture to remove soluble contaminates.

8. The cleaning system according to claim 1, wherein the pressurization means pressurizes the entrance chamber with a vapor component of liquified compressed gaseous solvent mixture evacuated from the exit chamber.

9. The cleaning system according to claim 1, wherein the pressurization means pressurizes the exit chamber with a vapor component of liquified compressed gaseous solvent mixture evacuated from the entrance chamber.

10. A cleaning method for cleaning articles with a liquified compressed gaseous solvent mixture including at least one liquified gaseous fluid in its subcritical state, the cleaning method comprising:

placing articles to be cleaned in an entrance chamber;

pressurizing the entrance chamber with the liquified compressed gaseous solvent mixture in a gaseous form;

moving the articles from the pressurized entrance chamber to a cleaning chamber containing the liquefied compressed gaseous solvent mixture at a subcritical state, the liquified compressed gaseous solvent mixture having a liquid/gas interface;

agitating the articles and the liquified compressed gaseous solvent mixture within the cleaning chamber to remove contaminants from the articles;

pressurizing an exit chamber with liquified compressed gaseous solvent mixture in a gaseous form;

moving the articles from the cleaning chamber to the pressurized exit chamber;

depressurizing the exit chamber and removing the cleaned articles; and wherein the cleaning method operates in a continuous sequence.

11. The cleaning method according to claim 10, wherein the entrance chamber is pressurized with a vapor component of liquified compressed gaseous solvent mixture which is evacuated from the exit chamber.

12. The cleaning method according to claim 10, wherein the exit chamber is pressurized with a vapor component of liquified compressed gaseous solvent mixture which is evacuated from the entrance chamber.

13. The cleaning method according to claim 10, wherein the articles are moved from the pressurized entrance chamber to the cleaning chamber and from the cleaning chamber to the pressurized exit chamber by a pressure differential.

14. The cleaning method according to claim 10, wherein the articles are moved from the pressurized entrance chamber to the cleaning chamber and from the cleaning chamber to the pressurized exit chamber by mechanical means.

15. The cleaning method according to claim 14, wherein the mechanical means includes sloped floors of the chambers.

16. The cleaning method according to claim 10, wherein the agitation of particles within the cleaning chamber is performed by moving a perforated tray.

17. The cleaning method according to claim 10, wherein the liquified compressed gaseous solvent mixture within the cleaning chamber is recirculated through a fluid recovery system which removes contaminants during the cleaning operation.

18. The cleaning method according to claim 10, wherein the steps are repeated in a continuous repeating sequence such that a new load of articles to be cleaned is already in the entrance chamber when the exit chamber is being depressurized for removal of the cleaned articles.

19. The cleaning method according to claim 10, wherein the liquified compressed gaseous solvent mixture includes a carbon dioxide based solvent.

20. The cleaning method according to claim 10, wherein the liquified compressed gaseous solvent mixture includes at least one of a surfactant, a brightener, and a coupling agent.

21. The cleaning method according to claim 10, wherein the liquified compressed gaseous solvent mixture includes at least two solvents.

22. The cleaning system according to claim 1, wherein the recirculation means maintains the liquified compressed gaseous solvent mixture at a subcritical state in which the liquified compressed gaseous solvent mixture has a liquid/gas interface between a liquid portion and a gas portion.

23. The cleaning system according to claim 22, wherein the agitation means provides a vigorous agitation of the articles to be cleaned due to a difference in density between the liquid and gas portions of the liquified compressed gaseous solvent mixture.

24. The cleaning system according to claim 1, wherein the recirculation means maintains a carbon dioxide based liquified compressed gaseous solvent mixture at a subcritical pressure of from about 500 psig to about 1000 psig.

25. The cleaning method according to claim 10 wherein the cleaning chamber is maintained at a subcritical state in which the liquified compressed gaseous solvent mixture has a liquid portion and a gas portion.

26. The cleaning method according to claim 25, wherein the agitation step provides a vigorous agitation of the articles to be cleaned due to a difference in density between the liquid and gas portions of the liquified compressed gaseous solvent mixture.

27. The cleaning method according to claim 10, wherein the cleaning chamber contains a carbon dioxide based liquified compressed gaseous solvent mixture at a subcritical pressure of from about 500 psig to about 1000 psig.

28. The cleaning system according to claim 2, wherein the reciprocating tray is configured to move the articles through a liquid/gas interface of the liquified compressed gaseous solvent mixture.

29. The cleaning method according to claim 10, wherein the step of agitating the articles includes moving the articles through a liquid/gas interface of the liquified compressed gaseous solvent mixture.

* * * * *

UNITED STATES PATENT AND TRADEMARK OFFICE

CERTIFICATE OF CORRECTION

PATENT NO. : 6,051,421

DATED : April 18, 2000

INVENTOR(S) : Richard A. Sauer et al.

It is certified that error appears in the above-identified patent and that said Letters Patent is hereby corrected as shown below:

Claim 10, line 9, please delete "liquefied" and insert --liquified--.

Claim 16, line 2, please delete "particles" and insert --articles--.

Signed and Sealed this

Twenty-seventh Day of March, 2001

Nicholas P. Godici

*Attest:*

NICHOLAS P. GODICI

*Acting Director of the United States Patent and Trademark Office*

*Attesting Officer*